US011744344B1

(12) United States Patent
Tanner

(10) Patent No.: US 11,744,344 B1
(45) Date of Patent: Sep. 5, 2023

(54) CURLING DEVICE

(71) Applicant: Mary Vitucci Tanner, Las Vegas, NV (US)

(72) Inventor: Mary Vitucci Tanner, Las Vegas, NV (US)

( * ) Notice: Subject to any disclaimer, the term of this patent is extended or adjusted under 35 U.S.C. 154(b) by 146 days.

(21) Appl. No.: 17/147,241

(22) Filed: Jan. 12, 2021

(51) Int. Cl.
*A45D 2/12* (2006.01)
*A45D 7/00* (2006.01)

(52) U.S. Cl.
CPC ..... *A45D 2/127* (2013.01); *A45D 2/125* (2013.01); *A45D 7/00* (2013.01)

(58) Field of Classification Search
CPC ... A45D 2/00; A45D 2/02; A45D 2/08; A45D 2/10; A45D 2/12; A45D 2/122; A45D 2/125; A45D 2/127; A45D 2/14; A45D 2/146; A45D 2/148; A45D 2/18; A45D 2/20; A45D 2/22; A45D 2/2464; A45D 2/28; A45D 2/38; A45D 7/00; A45D 7/045; A45D 8/00; A45D 8/34
See application file for complete search history.

(56) References Cited

U.S. PATENT DOCUMENTS

| | | | | |
|---|---|---|---|---|
| 3,680,565 | A * | 8/1972 | Giles | A45D 2/38 132/224 |
| 6,079,422 | A * | 6/2000 | Drago | A45D 2/362 132/246 |
| 2005/0205106 | A1* | 9/2005 | Mackinder | A45C 11/26 132/233 |
| 2008/0302381 | A1* | 12/2008 | Tojo | A45D 2/18 132/222 |
| 2013/0186420 | A1* | 7/2013 | Oates | A45D 2/2435 132/200 |
| 2016/0367002 | A1* | 12/2016 | Kraszewski | A45D 2/127 |
| 2017/0224078 | A1* | 8/2017 | Morris | A45D 2/02 |

* cited by examiner

*Primary Examiner* — Cris L. Rodriguez
*Assistant Examiner* — Karim Asqiriba
(74) *Attorney, Agent, or Firm* — Lewis Roca Rothgerber Christie LLP

(57) ABSTRACT

A curling device comprising a flap and a channel connected to each other. A curling member having an elongated shape and a curved cross-section is implemented in the channel. The curling member is capable of transitioning between an extended configuration and a curled configuration. The channel has a curved cross-section corresponding to the curling member's curved cross-section, which creates a trough, whereby hair can be positioned in the trough and held therein by wrapping the flap over the trough and around the channel. Transitioning the curling member from an extended configuration to a curled configuration holds the flap and the hair in a curved configuration, which imparts a curl to the hair when the hair is held in the curled configuration for some time.

14 Claims, 3 Drawing Sheets

CURLING DEVICE

FIELD OF INVENTION

This invention concerns haircare products, and more specifically, a device for curling hair.

BACKGROUND

Hair curling products are commonly available in various configurations and sizes. They function to hold hair in a curled position, usually after washing as the hair dries, so that the hair assumes curled characteristics, which is visually appealing and desirable.

Existing hair-curling devices suffer from several drawbacks. They are usually cumbersome to implement in the hair, consuming effort and time in the process. The person implementing the device must manually roll hair around the device in a tedious process. Further, the devices tend to have abutments or bristles surrounding the body of the device, which are designed to hold the hair and help the device stay in place during the curling process with hair wrapped around the device. However, the bristles or abutments can be prickly or uncomfortable, both for the person implementing the hair-curling device and for the person whose hair is being curled. Further, removing the device from the hair after the curling process is a tedious process and may be uncomfortable. Hair tends to get entangled between the bristles and removing the devise pulls the hair along with it. The removal process can be cumbersome and time-consuming as well, sometimes painful for the person whose hair is being curled.

Accordingly, there is a need for a hair-curling devise that is easy and fast to implement in a person's hair, and which is easy and fast to remove from the hair after use.

COPYRIGHT NOTICE

© 2020 Mary Vitucci Tanner. The disclosure in this patent document includes material that is subject to copyright protection. The copyright owner consents to fair use by facsimile reproduction of the patent document or of the patent disclosure as it appears in the U.S. Patent and Trademark Office's records. Apart from that, all copyright rights to the disclosure herein are expressly reserved. 37 CFR § 1.71(d).

SUMMARY OF THE INVENTION

A curling device comprises a flap and a channel connected to each other. The flap is made of a flexible material and has a relatively flat surface.

A curling member is implemented in the channel. The curling member has an elongate shape with two opposite sides and a curved cross-section. The curling member's curved cross-section provides it a convex side with an opposite concave side. The curling member is made of metal in one embodiment. The curling member is capable of transitioning between an extended configuration and a curled configuration by virtue of its construction and design. It transitions from an extended configuration to a curled configuration automatically when pressure is applied on its convex side. It can be transitioned back from its curled configuration to it extended configuration by unrolling it from its curled position and extending it until it snaps into the extended configuration.

The channel comprises a trough, which corresponds to the concave side of the curling member implemented therein.

Hair can be positioned in the trough and held in the trough by folding over and wrapping the flap over the trough. The flap may be secured in such wrapped configuration by a securing means, whereby the hair is held in the trough by the flap. In other embodiments, the flap can continue to be wrapped around the channel past the trough.

The securing means holds the flap in its wrapped configuration after it is wrapped over the trough or around the channel. Securing means may comprise one or more magnets, velcro, a zipper, snap-fasteners, an elastic band, or the like, implemented on the flap.

Transitioning the curling member from an extended configuration to a curled configuration holds the flap wrapped around it in a wrapped and curled configuration, along with the hair held in the trough in a curled position. Upon being held in such curled position for some time, the hair assumes curled characteristics.

BRIEF DESCRIPTION OF THE FIGURES

The invention can be better understood with reference to the figures. In the figures, like reference numerals designate corresponding parts throughout the different figures and views.

DETAILED DESCRIPTION

The systems, methods, and apparatus of the present invention are described below with reference to the figures. The description and figures are for illustrative purposes only, they do not limit the true scope and spirit of the present invention. The true scope and spirit of the present invention is evidenced by all parts of the disclosure herein, including but not limited to the Summary, the Figures, the Detailed Description, and the claims, along with equivalents thereof.

Figure 1:
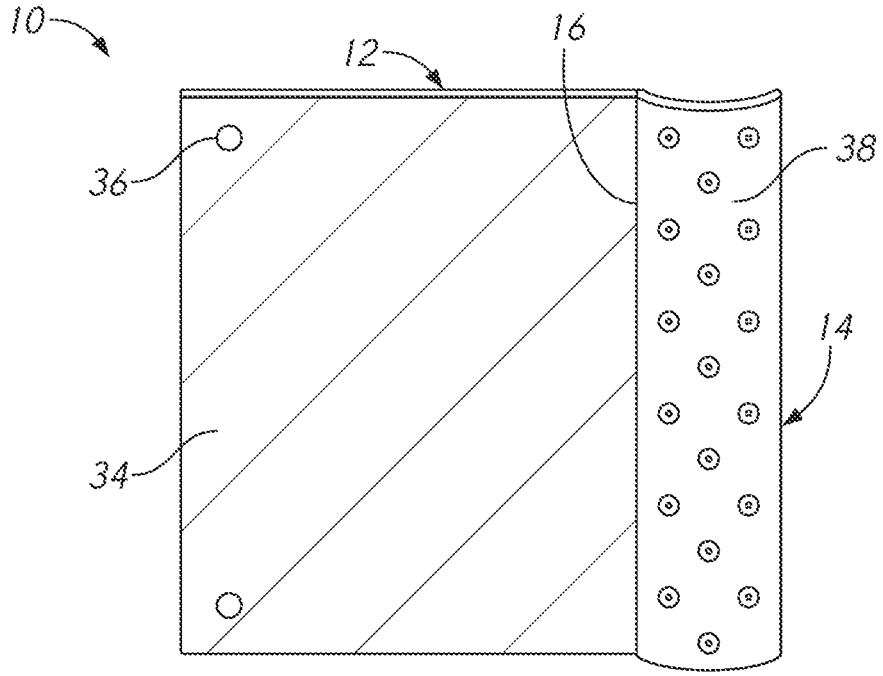
FIG. 1 shows a first view of one embodiment of a hair-curling device of the present invention in an extended and unwrapped configuration.

FIG. 1 shows a first view of one embodiment of a hair-curling device 10 according to the present invention. Device 10 is depicted in FIG. 1 in an extended and unwrapped configuration.

Device 10 comprises a flap 12 and a channel 14. Flap 12 comprises a relatively flat piece of a flexible material. The material is typically a fabric material, although it may be any known flexible material suitable for use in the present device, such as leather, PVC, vinyl, or the like. The fabric may be any type of fabric known in the art, such as cotton, polyester, silk, satin, elastic fibers like spandex, terrycloth, a blend of different materials, or the like. Flap 12 in one embodiment comprises a fabric that is a blend of 95% polyester and 5% spandex.

Figure 2:
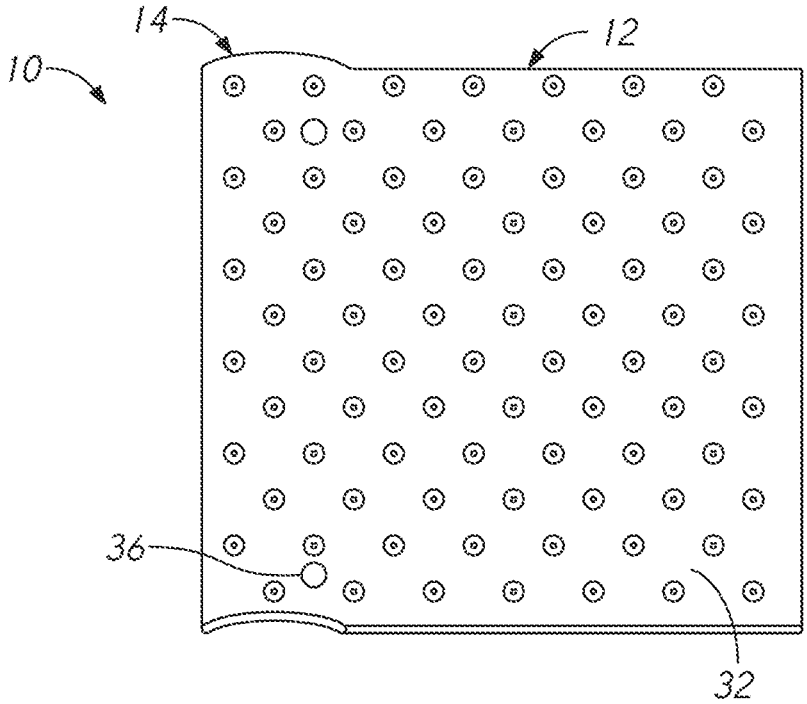
FIG. 2 shows a second view of the embodiment shown in FIG. 1 with the device in an extended and unwrapped configuration.

FIG. 2 shows a second view of the embodiment of device 10 shown in FIG. 1, with device 10 in an extended and unwrapped configuration.

Flap 12 extends to channel 14 along an edge 16 as shown in FIGS. 1 and 2. Edge 16 is common to both flap 12 and channel 14. In one embodiment, flap 12 and channel 14 are separate components that are operatively connected to each other at edge 16. They may be connected to each other in any manner known in the art, such as by a zipper, with metallic or plastic snap-fasteners, with velcro, by magnets, or the like.

In another embodiment, the material of flap 12 is one continuous piece of material that extends beyond edge 16 and wraps around a curling member 20. In this embodiment, the material of flap 12 is selectively removable from the curling member 20, whereby it can be cleaned, washed, or even switched out for a different flap 12. Implementation of flap 12 in this embodiment, and its removal, can be accomplished at edge 16 by any means known in the art, such as with a zipper, metal or plastic snap-fasteners, velcro, magnets, or the like. In one embodiment, flap 12 is sewn at edge 16, whereby curling member 20 is sewn shut in channel 14 and flap 12 is not removable from device 10.

In the embodiment shown in FIGS. 1 and 2, device 10 has a rectangular shape when in an unwrapped and extended configuration. This embodiment has a width of about five inches and a height of about nine inches. However, it is anticipated that the actual width and height of device 10 will vary by embodiment, and will typically depend on the performance requirements and implementation of the respective embodiment. Across various embodiments, the width of device 10 will range anywhere from about 1.5 inches to about 14 inches, and the height will range anywhere from about 3 inches to about 18 inches.

Figure 3:
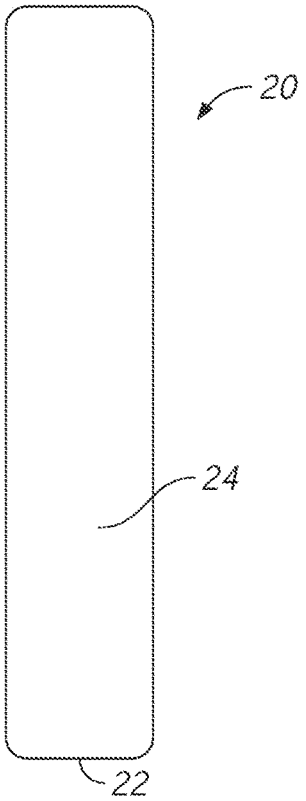
FIG. 3 shows a top view of a curling member of the device of FIG. 1 in an extended configuration.

FIG. 3 shows a top view of curling member 20 in an extended configuration. Curling member 20 is implemented in channel 14. Curling member 20 is capable of stably existing in more than one configuration, with an extended configuration being one of them. Curling member 20 is preferably constructed of a resilient material. The material is a metal or a metal alloy in one embodiment.

The dimensions of curling member 20 will depend on the dimensions of the corresponding device 10. Typically, the width and length of curling member will be slightly less than the width and length of channel 14 in the respective embodiment. Having such dimensions helps facilitate curling member's 20 implementation in channel 14. In one embodiment, curling member 20 has a length of about nine inches and a width of about one inch.

The thickness of the material of curling member 20 will typically vary by embodiment, and depend on the length of curling member 20. In one embodiment the length of curling member 20 is about 9 inches, its width is about 1 inch, and the thickness of its material is about 0.0075 inches.

In one embodiment, curling member 20 has a coating, or covering, implemented on its surface. The coating is relatively thin, and in one embodiment covers substantially all surfaces of curling member 20. The coating is designed to provide a softer or cushioned characteristic to the exterior of curling member 20. Such coatings are known in the art, and it is anticipated that the coating may be any material used in the art for such purposes. In one embodiment, the coating comprises silicone. In alternate embodiments, the coating may comprise rubber, plastic, resin, craft foam, vinyl, PVC, leather, fabric, a synthetic material, or the like. In one embodiment, the thickness of the coating is about 1/16 of an inch. In each embodiment, however, the thickness of the coating is preferably relatively thin in order for it to not substantially interfere with curling member's 20 transition between its extended configuration and its curled configuration.

Figure 4:
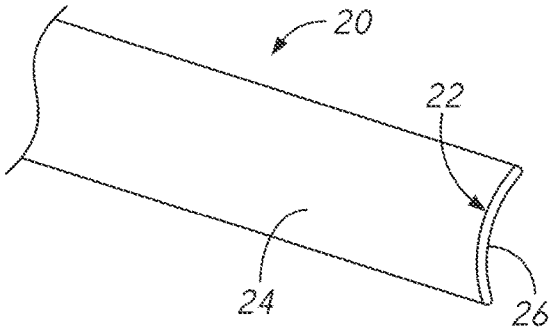
FIG. 4 shows a perspective elevated side view of the curling member of FIG. 3 in an extended configuration.

Curling member 20 has an elongated shape, akin to a strip, with a slight curvature width-wise. FIG. 4 shows a perspective elevated side view of curling member 20 in an extended configuration. This view shows the curling member's 20 width-wise curvature at a width-wise edge 22. Curling member's 20 width-wise curvature does not have to be significant, and it is anticipated that the amount of curvature will vary from one embodiment to another, typically depending on the length and width of curling member 20 and the thickness of its material in the respective embodiment. In one embodiment, curling member's 20 width-wise curvature is about 2.5 inches.

Due to curling member's 20 width-wise curvature, curling member 20 possesses a convex side 24 and a corresponding concave side 26 on the opposite side, as visible in FIG. 4.

The construction of curling member 20 makes it capable of curling outwards, along its convex side 24, and roll into a curled configuration. In some embodiments such curling characteristic is implemented in curling member 20 by creasing, or scoring, the convex side 24 of curling member 20 over a cylindrical surface that has a relatively small diameter. However, it is anticipated that the curling characteristic may be implemented in the material of curling member 20 by any other process or means known in the art for implementing such curling characteristic. Such construction of curling member 20 is known in the art, such as for slap bracelets.

Curling member's 20 transition to a curled configuration occurs when pressure is applied on its convex surface 24 while it is in an extended configuration. The pressure causes curling member 20 to bend, which causes curling member to snap out of its extended position and automatically roll into a curled configuration along its convex surface 24.

While in a curled configuration, curling member 20 stably stays in such curled configuration until curling member 20 is physically unrolled and extended. When curling member 20 is unrolled from its curled configuration and straightened out, it returns to its previous extended configuration, snapping into the extended configuration and stably staying in the extended configuration. This step typically involves curling member 20 snapping into the extended configuration, which helps it stably stay in the extended configuration.

Flap 12 has a front side 32 and a back side 34. Front side 32 of flap 12 may incorporate an artistic design or print for aesthetic reasons. Back side 34 of flap 12 may also incorporate a design or a print, although back side 34 will usually be concealed when device 10 is in use.

Curling member 20 is implemented in channel 14 with its convex side 24 facing flap's 12 front side and its concave side 26 facing flap's 12 back side 34. Curling member 20 is substantially firmly implemented in channel 14. In such implementation, one skilled in the art will appreciate that flap 12 and its flexible material will extend or curl along with curling member 20 in curling member's 20 extended and curled configurations.

Figure 6A:
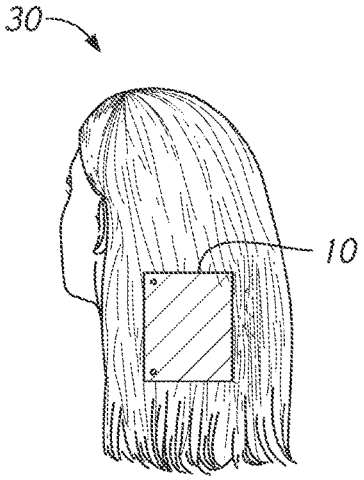
FIG. 6*a* shows the device of FIG. 1 positioned in a person's hair in an unwrapped and extended configuration for implementation to curl a portion of the person's hair.

Curling device 10 is usable to curl hair. FIG. 6*a* shows curling device 10 positioned in a person's 30 hair for implementation. In FIG. 6*a*, Device 10 is shown in an extended and unwrapped configuration prior to use. A portion of the person's 30 hair is placed lengthwise in channel 14. Channel 14 will have a trough 38 running lengthwise in device 10 due to the concave side 26 of curling member 20 in channel 14. Trough 38 will have a curved cross-section that corresponds to the concave side 26 of curling member 20. Hair can be placed in trough 38, and flap 12 can be wrapped over it along edge 16. Flap 12 will cover the trough 38 created by concave side 26 of curling member 20, including the hair in trough 38. One skilled in the art will recognize that the hair in trough 38 will be held in trough 38 by the flap 12 covering it.

In one embodiment Flap 12 is wide enough that it can continue to be wrapped around over the convex side 24 of curling member 20 in channel 14. In one embodiment, flap 12 is wide enough to allow it to continue being wrapped again around curling member 20, over its previously covered trough 38 in concave side 26 in channel 14. Flap 12 can thus be wrapped around both sides of channel 14, with the curling member 20 in channel 14, depending on the width of flap 14 is the respective embodiment.

Figure 6B:
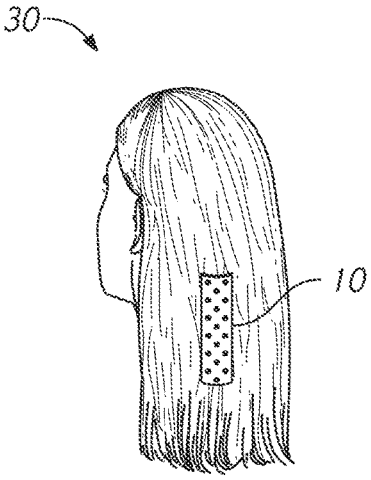
FIG. 6*b* shows the device and person of FIG. 6*a* with the hair-curling device implemented in a wrapped configuration in the person's hair.

FIG. 6*b* shows the person 30 of FIG. 6*a* with hair-curling device 10 implemented in a wrapped and extended configuration in the person's 30 hair. This configuration is achieved by wrapping flap 12 over at least the trough 38, and around channel 14 in some embodiments. Hair in trough 38 will thus be covered by flap 12.

Flap 12 in one embodiment includes one or more securing means 36 attached to it in order to help hold flap 12 in curling device's 10 wrapped configuration. In one embodiment, securing means 36 is implemented on the back side 34 of flap 12. Securing means 36 may be any means known in the art for such purpose. In one embodiment, securing means 36 comprises a magnet that is attracted to the metallic material in curling member 20, whereby the magnet sticks to the curling member 20 when flap 12 is wrapped around channel 14, thereby holding flap 12 in the wrapped configuration. In another embodiment, flap 20 includes a corresponding magnet implemented on the front side 32 of flap 12, whereby the two magnets are attracted to each other and therefore stick together, thereby holding flap 12 in the wrapped configuration.

In alternate embodiments, securing means 36 may be velcro, metallic or plastic snap-fasteners, or the like, with corresponding mating components implemented on the back side 34 and on the front side 32 of flap 12. In another embodiment securing means 36 may be an elastic band connected to flap 12, designed to operatively connect to a corresponding hooking member or to wrap around the device 10 in order to hold flap 12 in a wrapped configuration. All such embodiments are anticipated and are intended to be covered by the present claims.

Figure 5:
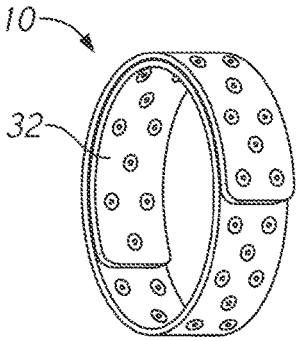
FIG. 5 shows the device of FIG. 1 in a wrapped and curled configuration.

In a wrapped configuration, when pressure is applied on the convex side 24 of curling member 20, curling member 20 will automatically roll into a curled configuration. With flap 12 wrapped around channel 14, flap 12 will curl along with curling member 20. FIG. 5 shows curling device 10 in a wrapped and curled configuration. In this configuration, the front side 32 of flap 12 is visible in a wrapped configuration around channel 14, while the back side 34 of flap 12 is hidden from view.

Figure 6C:
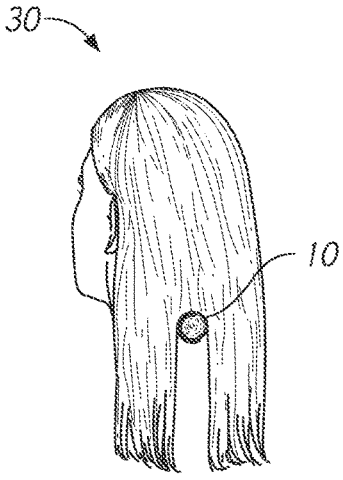
FIG. 6*c* shows the device and person of FIGS. 6*a* and 6*b* with the hair-curling device implemented in a wrapped and curled configuration in the person's hair.

While device 10 is in use in a wrapped and curled configuration, with hair held in trough 38, the hair will curl along with curling device 10. FIG. 6*c* shows person 30 with hair-curling device 10 implemented in a wrapped and curled configuration in their hair. One skilled in the art will see that curling device 30 will be held in place in the person's 30 hair with the curling device 10 in a curled configuration and a portion of the person's 30 hair held inside in trough 38.

Curling device 10 can thus stay implemented and held in the person's 30 hair with hair being held in a curled state. After some time being held in such curled state, the hair will assume curled characteristics. This is especially true when the hair is wet or damp, and is allowed to dry somewhat while being held in a curled position.

After a desired amount of time, curling device 10 can be unrolled back into its extended and wrapped configuration. Securing means 36 can be released, and flap 12 can be unwrapped from channel 14. This will expose trough 38 and release the hair that was being held therein. Curling device 10 can then be removed from the person's 30 hair. Device 10 can then be reused.

In an alternate embodiment, the person's 30 hair can be released from curling device 10 by applying an outward force on the device 10. One skilled in the art will appreciate that the person's 30 hair in trough 38 will slide out from trough 38 due to the outward force being applied on device 10, even though device 10 remains in a wrapped and curled configuration. Device 10 can thus be freed from the person's 30 hair and removed.

It can be appreciated that several curling devices 10 can be simultaneously implemented in person's 30 hair, to hold and curl different portions of their hair simultaneously. This is beneficial in the interests of time when curling separate portions of a person's hair is desired.

It can be further appreciated that curling device 10 can be made in different sizes, whereby different devices 10 may be used for curling different lengths of hair, depending on a user's particular preference at the time. Further, varying lengths of curling device 10 can be implemented simultaneously in person's 30 hair to achieve the particular desired curling of their hair.

Two or more curling devices 10 may be used in a serial configuration for the purposes of curling a longer amount of hair. For this purpose, two or more curling devices 10 are used separately on the same lock of hair, with the curling devices 10 positioned in serial lengthwise configuration with respect to each other. In one embodiment, curling devices 10 include a means constructed in flap 12 to connect the curling device 10 with another curling device 10. With such feature, two or more curling devices 10 can be interconnected with each other, in a daisy-chain configuration. The means to connect two curling devices 10 to each other may comprise any means known in the art for such purpose, such as velcro, metallic snap-fasteners, plastic snap-fasteners, a zipper, magnets, or the like. All such embodiments are anticipated, and fall within the spirit and scope of the present invention.

Figure 7:
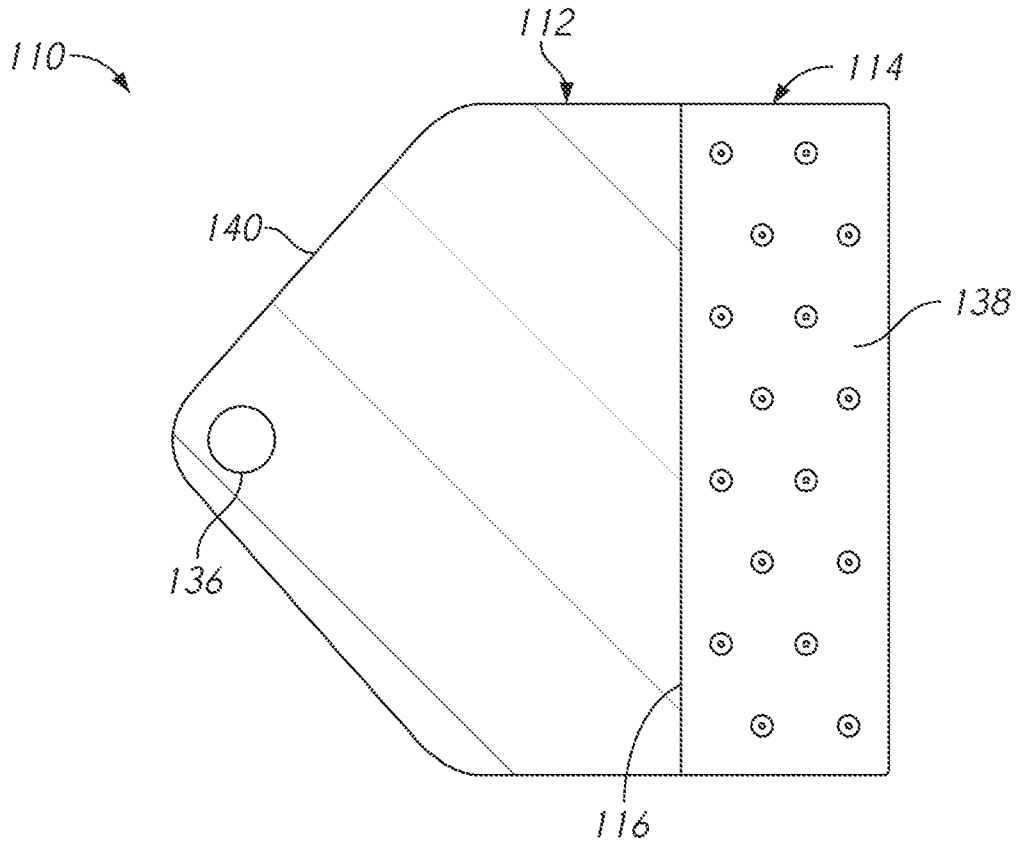
FIG. 7 shows an alternate embodiment of the hair-curling device of the present invention in an extended and unwrapped configuration.

Flap 12 is shown in FIGS. 1 and 2 as rectangular in shape. However, it is anticipated that flap 12 may have a different shape or construction in alternate embodiments, such as a rounded shape, a semi-circular shape, a triangular shape, or even a combination thereof. FIG. 7 shows an alternate embodiment of a curling device 110 in accordance with the teachings of the present invention. In this embodiment, flap 112 has a combination of a rectangular portion 142 with a triangular portion 140. Triangular portion 140 includes a means 136 for connecting flap 112 to an outer surface of channel 114 when flap 112 is wrapped around channel 114. A curved trough 138 in channel 114 serves to hold a lock of hair. When flap 112 is wrapped over trough 138, and around channel 114, rectangular portion 142 will fully cover the hair in trough 138. The triangular portion will continue wrapping around channel 114 and transition device 114 into its wrapped configuration. Device 110 can then be transitioned from an extended configuration to a curved configuration. Flap 112 will thus hold the hair in trough 138 during the curling process with device 110 in a wrapped and curled configuration.

The important aspect of all such embodiments and variations of flap 112 is that they substantially cover and hold the hair in trough 138. Including when device 110 is in a wrapped and curled configuration. Accordingly, all such variations of the design and shape of flap 12 are anticipated as they are consistent with the spirit and scope of the present invention, and are therefore intended to be covered by the present claims.

Although the devices, systems, apparatus and methods have been described and illustrated in connection with certain embodiments, variations and modifications will be evident to those skilled in the art. Such variations and modifications may be made without departing from the scope and spirit of the present disclosure, and are therefore anticipated. The description and teachings herein are thus not to be limited to the precise details of methodology or construction set forth herein because variations and modifications are intended to be included as equivalents within the scope and spirit of the present disclosures and teachings.

I claim:

1. A curling device, comprising:

a flap, said flap comprising:

a flexible material, a width, and a relatively flat surface, wherein said flap comprises a proximate edge and a distal edge, said proximate edge and said distal edge disposed opposite from each other across the width of said flap;

a channel, said channel operatively connected to said flap along said proximate edge of said flap;

a curling member implemented in said channel, wherein:

said curling member has an elongated shape with a concave side and a convex side, said concave side and said convex side disposed opposite from each other, said curling member is able to transition between an extended configuration and a curled configuration, and a trough runs along the length of said curling member, wherein the width of said flap allows the distal edge of said flap to be wrapped around said concave side of said curling member in said channel along the proximate side of said flap, and further around said convex side of said curling member in said channel to substantially cover said trough.

2. The curling device of claim 1, wherein:

said channel has a front side and a back side; and said flap has a predetermined width whereby said flap can be selectively wrapped around the front side and the back side of said channel more than once.

3. The curling device of claim 1, wherein said flap further comprises a holding unit configured to hold said flap in the curled configuration, wherein said holding unit comprises a first mating component and a second mating component, said first mating component and said second mating component are configured to hold said flap in the curled configuration when said first mating component is engaged with said second mating component.

4. The curling device of claim 3, wherein said flap further comprises a front side and a back side, and said first mating component implemented on the front side of said flap and said second mating component implemented on the back side of said flap.

5. The curling device of claim 3, wherein said holding unit comprises one of:

a zipper, a magnet, velcro, metallic snap-fasteners, plastic snap-fasteners, and an elastic band.

6. The curling device of claim 5, wherein the flexible material of said flap comprises one of:

leather, PVC, vinyl, cotton, polyester, silk, satin, an elastic fiber, and terrycloth.

7. The curling device of claim 1, wherein:

said curling member transitions from the extended configuration to the curled configuration when pressure is applied on said convex side.

8. The curling device of claim 7, wherein:

said curling member is made of metal, said metal having a thickness of about 0.0075 inches, a length of about 9 inches, and a width of about 1 inch.

9. The curling device of claim 7, wherein said curling member comprises a coating on said curling member, and said coating comprises at least one of:

silicone, rubber, plastic, resin, craft foam, vinyl, PVC, leather, fabric, and a synthetic material.

10. The curling device of claim 7, wherein the trough in said channel corresponds to the concave side of said curling member.

11. The curling device of claim 1, wherein a length and a width of said curling member are smaller than a corresponding length and width of said channel.

12. The curling device of claim 11, wherein said material of said flap extends into said channel and holds said curling member in said channel.

13. A device for curling hair, comprising:

a flap, said flap comprising:

a flexible material with a substantially flat surface, said flexible material having a width, a front side, and a back side, wherein said flap comprises a proximate edge and a distal edge disposed opposite from each other across said width;

a channel, said channel comprising:

a first edge, a front side said, and a back side, said back side disposed opposite to said front side, wherein:

said first edge of the channel is connected to said proximate edge of the flap; and a curling member is implemented in said channel, said curling member comprising:

an elongated body, a concave side having a concave shape running along the curling member's elongated body, wherein said concave side forming a trough, a convex side having a convex shape running along the curling member's elongated body, said convex side disposed on an opposite side of said concave side, wherein:

said curling member's convex side conforms to the front side of said channel, said curling member's concave side conforms to the back side of said channel, said curling member is able to stably maintain an extended configuration, said curling member is able to stably maintain a curled configuration, and said curling member is able to transition between said extended configuration and said curling configuration; wherein:

the width of the flexible material of said flap is wide enough to fold the distal edge of said flap at said proximate edge of the flap and wrap the distal edge around said curling member wherein said convex side of said curling member and said concave side of said curling member are wrapped around by said flap to cover said trough.

14. The device for curling hair of claim 13, further comprising a holding unit configured to hold said flap covering said trough in the curled configuration, said holding unit comprising:

a first mating component implemented on the back side of said flap, and a second mating component implemented on the front side of said flap, wherein:

said first mating component and said second mating component are configured to hold said back side of said flap and said front side of said flap together while said flap is covering said trough, when said first mating component is engaged with said second mating component.

* * * * *